US009912026B2

(12) United States Patent
Acar

(10) Patent No.: US 9,912,026 B2
(45) Date of Patent: Mar. 6, 2018

(54) LOW-LOSS CONTINUOUSLY TUNABLE FILTER AND RESONATOR THEREOF

(71) Applicant: Microelectronics Technology Inc., Hsinchu (TW)

(72) Inventor: Öncel Acar, Copenhagen (DE)

(73) Assignee: Microelectronics Technology Inc., Hsinchu (TW)

( * ) Notice: Subject to any disclaimer, the term of this patent is extended or adjusted under 35 U.S.C. 154(b) by 160 days.

(21) Appl. No.: 14/920,899

(22) Filed: Oct. 23, 2015

(65) Prior Publication Data

US 2016/0118704 A1 Apr. 28, 2016

Related U.S. Application Data

(60) Provisional application No. 62/067,881, filed on Oct. 23, 2014.

(51) Int. Cl.
*H01P 1/205* (2006.01)
*H01P 1/217* (2006.01)
*H01P 7/04* (2006.01)

(52) U.S. Cl.
CPC ..... *H01P 1/217* (2013.01); *H01P 1/2053* (2013.01); *H01P 7/04* (2013.01)

(58) Field of Classification Search
CPC ..... H01P 1/20; H01P 1/2002; H01P 1/2007; H01P 1/202; H01P 1/205; H01P 1/2053; H01P 1/2056; H01P 1/215; H01P 1/217; H01P 1/218; H01P 7/04
USPC ..... 333/206, 207, 202, 203, 222, 223
See application file for complete search history.

(56) References Cited

U.S. PATENT DOCUMENTS 6,801,104 B2 * 10/2004 Zhu ..... H01P 1/2053 333/202
2008/0258847 A1 * 10/2008 Snyder ..... H01P 1/202 333/207

* cited by examiner

*Primary Examiner* — Stephen E Jones
(74) *Attorney, Agent, or Firm* — ScienBiziP, P.C.

(57) ABSTRACT

A tunable filter element comprises a resonator unit that defines a longitudinal axis, the resonator unit includes an inner conducting portion defining an inner shorting end along the longitudinal axis and an inner capacitive end opposing the inner shorting end, an outer conducting portion arranged around the inner conductor defining an outer shorting end along the longitudinal axis and an outer capacitive end opposite to the outer shorting end. The inner and the outer conductors maintain an annular gap there-between, and are coupled to form a shorting end at one end and a capacitive end at the other. The filter element further comprises a ferrite insert disposed between the inner and the outer conducting portions and substantially filling the annular gap, the ferrite insert being configured to receive a bias magnetic field in a direction substantially parallel to the longitudinal axis.

18 Claims, 8 Drawing Sheets

LOW-LOSS CONTINUOUSLY TUNABLE FILTER AND RESONATOR THEREOF

CROSS REFERENCE TO RELATED APPLICATIONS

This Applicant claims the benefit of U.S. Provisional Patent Application No. 62/067881, filed on Oct. 23, 2014, which is incorporated by reference in its entirety.

TECHNICAL FIELD

The instant disclosure relates generally to microwave filters, and, more particularly, to a continuously tunable filter.

BACKGROUND

Band-pass and band-rejection filters have been widely used to control the flow of signals that propagate in electronic circuits. A band-pass filter is an electrical filter that allows a band of frequencies comprising a signal to pass through the circuit with minimal loss. A band-rejection (band stop) filter, on the other hand, is an electrical filter that rejects or suppresses a band of frequencies.

Resonators are essential components found in filter devices. Conventional resonators frequently utilize air gaps in their structure. However, resonators can be built with ferrites to improve their loss characteristics. Resonators having ferrite components may be built in several configurations. Given a similar geometrical structure, it is a perspective view of a filter device utilizing a single resonator possible to obtain different propagation characteristics in ferrites by using different bias configurations.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
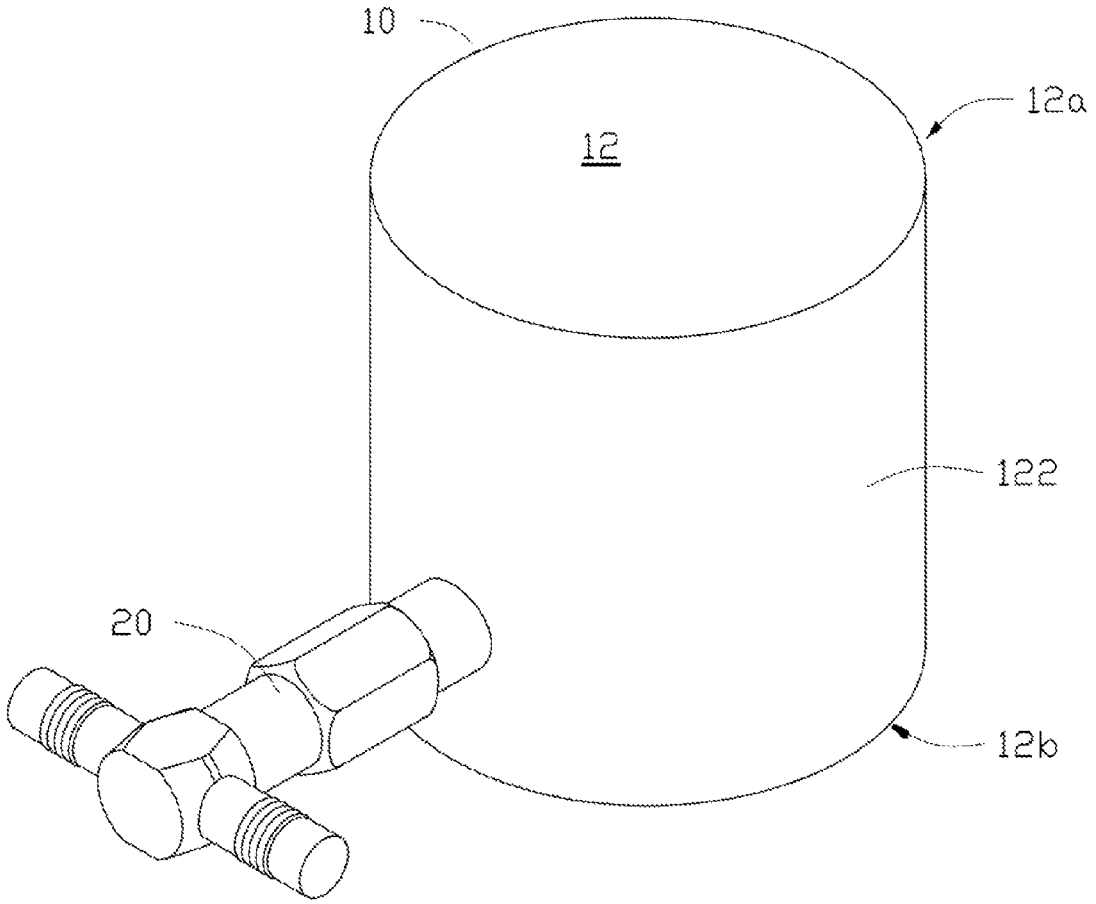
FIG. 1 shows configuration in accordance with some embodiments of the instant disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "top," "bottom," "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

For consistency purpose and ease of understanding, like features are identified (although, in some instances, not shown) with like numerals in the exemplary figures. However, the features in different embodiments may differ in other respects, and thus shall not be narrowly confined to what is shown in the figures.

High-performance tunable filters have been increasingly sought by the microwave community to meet the increasing demand for flexibility in radio communication systems. As radio transceiver architectures are evolving towards the software defined radio (SDR) concept, their frequency bands of operation (in addition to other system parameters) are subject to custom adjustments. To support the development to this end, most of the blocks in a radio frequency (RF) transceiver frontend apart from the filter (e.g. amplifiers, mixers, and so on) need to be designed with broad bandwidths covering the entire frequency span. The frontend filter, however, is the block that assures the system to function within a well-defined band, thus is desirable to be tunable across the targeted frequency span.

High tunability in filters is desirable to enable adjustments to the system's band of operation in a wide range of the frequency spectrum. However, the introduction of tunability in a filter device often compromises the loss performance thereof. This is due to the reduction in the quality factor (Q) of a tunable resonator compared to that of a static one. Striking a good balance between loss performance and tunability is essential, since typically in radio system designs there is hardly room for additional losses in frontend filters. Embodiments of the instant disclosure describe a continuously tunable filter configuration that allows wide tuning ranges while maintaining high resonator Q factors, thus retaining the desirable low-loss characteristics.

FIG. 1 shows a perspective view of a filter device utilizing a single resonator configuration in accordance with some embodiments of the instant disclosure. Particularly, FIG. 1 shows the external structural arrangement of an exemplary filter device 1 in accordance with some embodiments. Visible from external view, the filter device 1 comprises a resonator unit 10 having an outer conducting portion 12 that substantially resembles a circular cylinder. The cylindrical outer conducting portion 12 of the exemplary resonator unit 10 generally defines an upper end 12*a*, a lateral peripheral portion 122 that laterally extends downward from the upper end 12*a*, and an opposite bottom end 12*b*. A T-type coaxial connector 20 is attached to an outer surface of the lateral peripheral portion 122 and configured to enable signal access from/to an internal portion of the resonator unit 10 through a tapping port (not visible from instant view).

Figure 2:
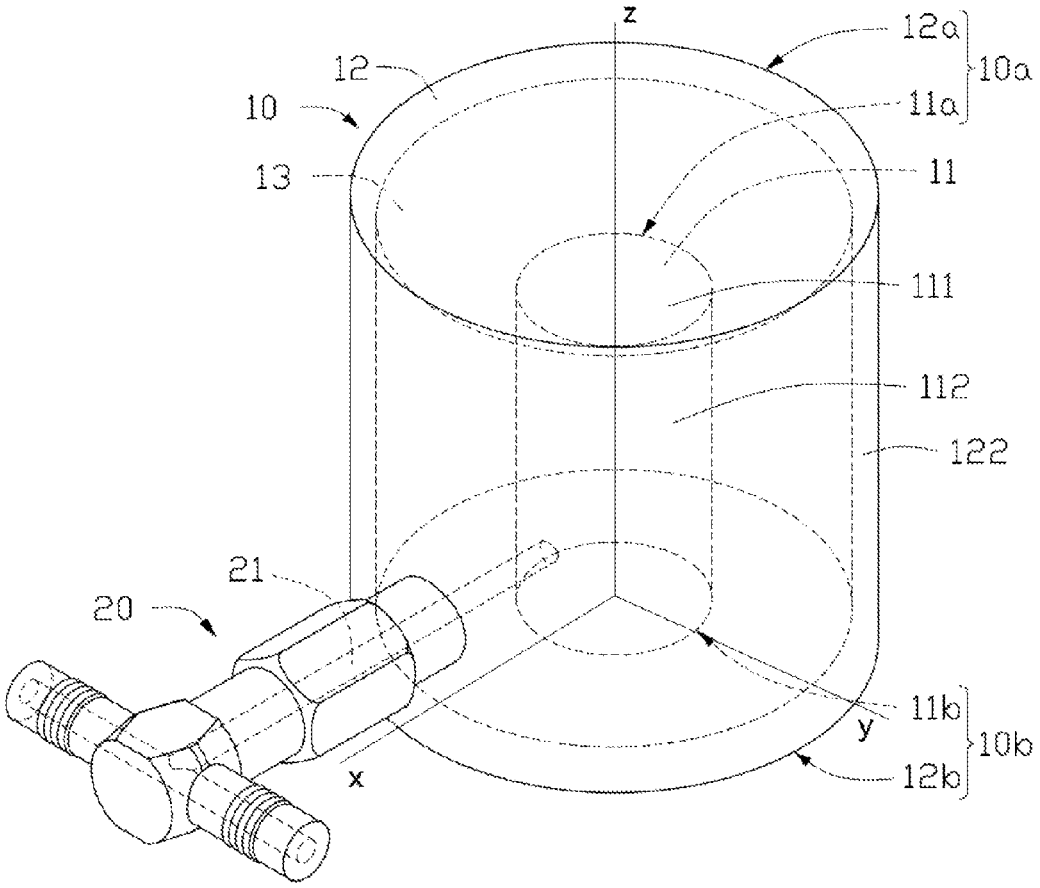
FIG. 2 is an isometric see-through illustration of a filter device utilizing a single resonator configuration in accordance with some embodiments of the instant disclosure.

FIG. 2 shows an isometric see-through illustration of a filter device utilizing a single resonator configuration in accordance with some embodiments of the instant disclosure. Particularly, the see-through view of FIG. 2 illustrates the structural arrangement inside the outer conductive portion 12 of the resonator unit 10. For the ease and accuracy of orientation referral, an x-y-z coordinate reference is provided. Specifically, the resonator unit 10 defines a longitudinal axis, which is shown to coincide with the z-axis in FIG. 2. Accordingly, a vector parallel to the x-y plane indicates a transverse direction with respect to the longitudinal axis. For instance, a transverse cross-sectional profile of the exemplary resonator unit 10 may be defined by an intercepting plane (parallel to the x-y plane) along the longitudinal axis (e.g., the z-axis).

The resonator unit 10 of the instant embodiment comprises a generally cylindrical body having a circular coaxial cross-sectional arrangement. Moreover, a transverse cross-sectional arrangement of the resonator unit 10 is substantially symmetrical about the longitudinal axis (e.g., structural symmetry across the height of the device). Specifically, the resonator unit 10 comprises an inner conducting portion 11, an outer conducting portion 12 having a hollow structure enclosing around the inner conducting portion 12 (e.g., constituting the visible portion in FIG. 1), and a ferrite insert 13 having a substantially annular tube profile interposing between the inner and the outer conductive portions 11, 12. A T-type coaxial connector 20 is attached to an outer lateral surface of the outer conductive portion to allow signal access to the inner conductive portion 12 through a tapping port 21. The location of the tapping port 21 along the height of the resonator unit 10 (e.g., along the longitudinal axis z) may affect a coupling coefficient of the filter device. Accordingly, the height displacement setting of the tapping port 21 may be utilized as a tuning factor for adjusting filter characteristics.

Figure 3A:
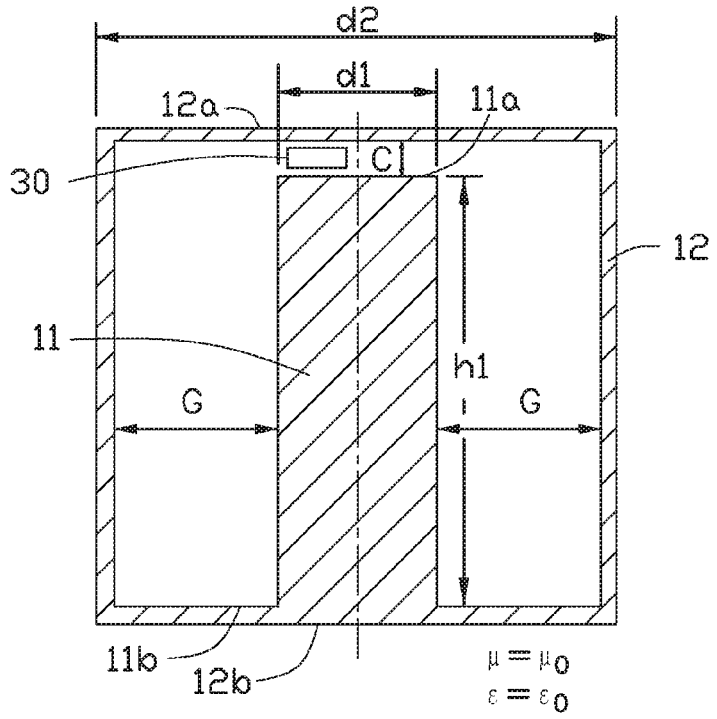
FIGS. 3A and 3B are cross-sectional illustrations of a filter element along the longitudinal axis thereof in accordance with some embodiments of the instant disclosure.
Figure 3B:
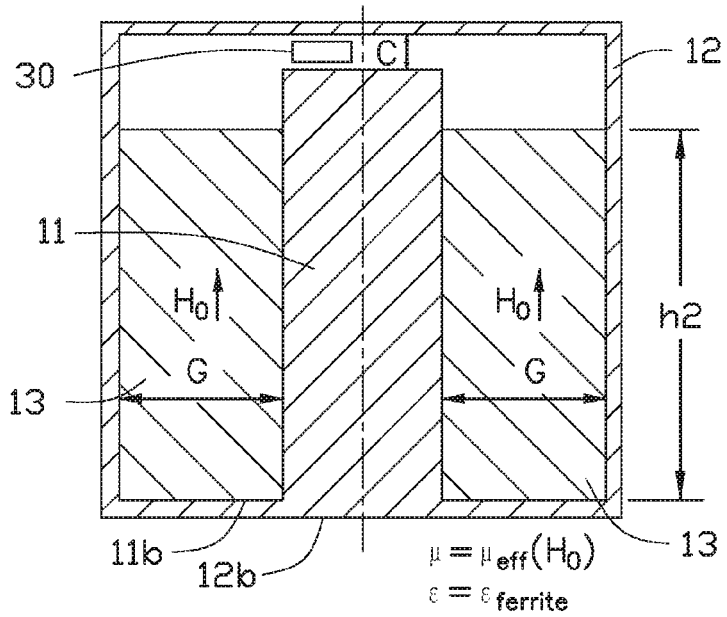

Referring concurrently to FIG. 3A and 3B, which show cross-sectional views of a filter element along the longitudinal axis thereof in accordance with some embodiments of the instant disclosure. The inner conductive portion 11 comprises a volume that substantially resembles a cylindrical pillar having a circular cross-sectional profile, which is substantially symmetric with respect to the longitudinal axis. The span of the inner conducting portion 11 along the longitudinal axis (e.g., the z-axis) defines an inner portion height hl (as illustrated in FIG. 3A). In addition, the inner conductor portion 11 defines a top end 11*a* (e.g., the end of the circular pillar that situates toward the upward direction along the z-axis) that extends laterally downward to form a lateral periphery portion 112 thereof. The inner conductor portion 11 further defines a bottom end 11*b* situated toward the x-y ground plane (e.g., where z=0). In the instant embodiment, the top end 11*a* of the inner conductive portion 11 defines a substantially flat surface 111 parallel to the x-y plane.

The outer conductive portion 12 comprises a hollow cylinder having a circular cross-sectional profile that is substantially symmetric about the longitudinal axis (e.g., the z-axis). The outer conducting portion 12 is arranged around the inner conducting portion 11 in an enclosing manner. As previously illustrated in FIG. 1, the outer conducting portion 12 generally defines an upper end 12*a* (e.g., the end of the hollow cylinder that situates toward the upward direction along the z-axis), a lateral peripheral portion 122 that laterally extends downward from the upper end 12*a*. The outer conductive portion 12 further defines a bottom end 12*b* that situates toward the x-y ground plane (e.g., where z=0). The respective bottom ends 11*b*, 12*b* of the inner and the outer conductive portions 11, 12 are electrically connected to create a short-circuit termination (i.e., a shorting end 10*b*) at the bottom portion of the resonator unit 10. In the instant embodiment, the shorting between the inner and outer conductive portions 11, 12 is established through a conductive bottom plate that structurally connecting the respective bottom ends 11*b*, 12*b* thereof. Other suitable shorting arrangements between the inner/outer conducting portions may also be adopted.

The longitudinal axis (e.g., the z-axis) may generally be an axis of symmetry for the resonator unit 10. It is noted that, while the instant exemplary embodiment utilizes a circular cross-sectional profile, other embodiments may adopt different suitable geometric arrangements, depending on specific applications and/or operational requirements. For instance, in some embodiments, the inner conductive portion 11 may include a rectangular cylinder structure having a transverse cross-section profile that substantially resembles a square. Likewise, the outer conductive portion 12 may be configured to take the form of a rectangular hollow enclosure, as long as the overall structure of the resonator unit 10 maintains substantially symmetry about the longitudinal axis.

Figure 7:
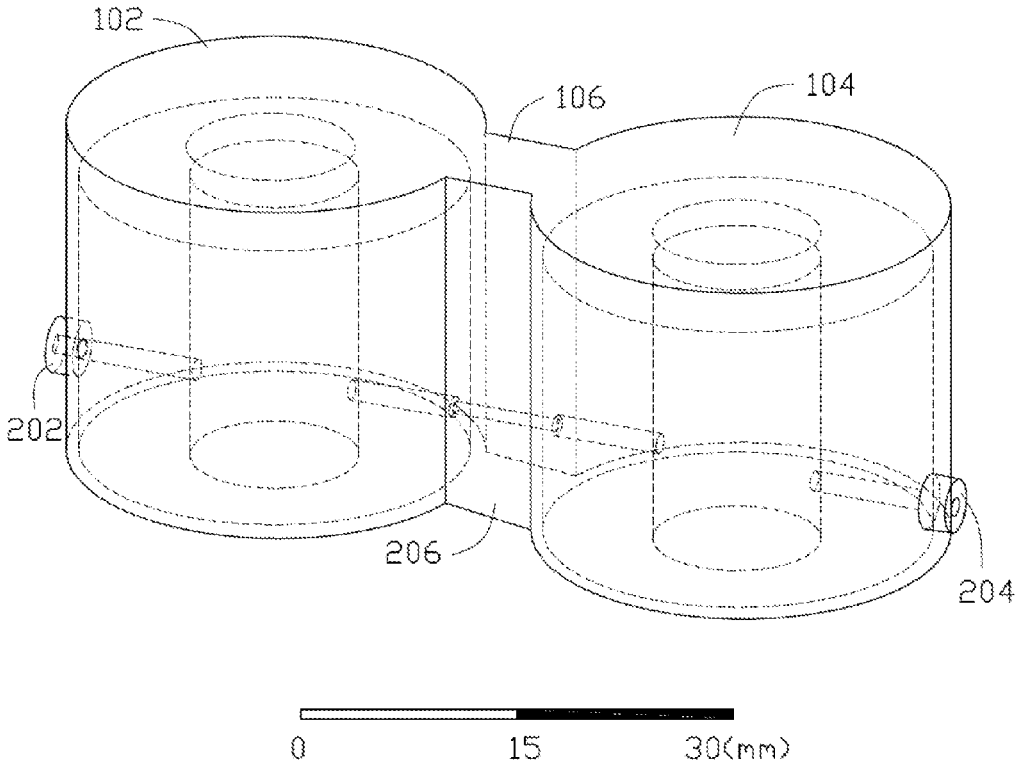
FIG. 7 shows an isometric see-through illustration of filter device utilizing a double resonator configuration in accordance with some embodiments of the instant disclosure.

In some embodiments, the outer conductive portion 12 may serve as housing for enclosing internal components. The components of the filter/resonator may be made of metal, but other materials such as plastic, may also be utilized, provided they are plated with good conductor. For instant, the exemplary embodiment shown in FIG. 2 utilizes a silver-plated housing to reduce losses and improve filter quality. In some embodiments, the inner and the outer conductive portions 11, 12 may be constructed as a single integrated unit through suitable techniques such as casting, molding, or pressing. In some embodiments, the inner and the outer conductor portions 11, 12 are manufactured as separate units and then mechanically coupled through suitable arrangements (such as a conductive bottom plate). Moreover, in other embodiments, an additional housing unit may be provided to offer further protection for the resonator unit 10 (as shown in FIG. 7)

Referring again to FIGS. 3A and 3B, the outer conducting portion 12 has a length (along the longitudinal axis) greater than that of the inner conducting portion 11 to ensure a sufficient cavity depth in its hollow internal, such that, upon coupling, an inner surface of the upper end 12*a* thereof maintains sufficient clearance from the upper end 11*a* (e.g., the top surface 111) of the inner conductive portion 11 to define a capacitive gap C (which is more clearly visible in FIGS. 3A/3B). The upper end of the resonator unit 10 that defines the capacitive gap C is referred to as the capacitive end 10*a*. In the instant embodiment, the capacitive gap C is substantially filled with air, thus forming a capacitive air gap. In some embodiments, additional dielectric insert 30 may be arranged in the capacitive gap C to modify the capacitance value thereof. The coaxial arrangement between the inner and the outer conductive portions 11, 12 generates a substantially circular annular gap G between their respective lateral peripheral portions 112, 122. Particularly, the annular gap G is defined between an inner surface of the outer lateral peripheral portion 122 and an outer surface of the inner lateral peripheral portion 112, thus forming a hollow circular ring between the inner and the outer conductive portions 11, 12 in a transverse cross-section normal to the longitudinal axis).

In the illustrated embodiment, the ferrite insert 13 is fillingly disposed between the inner and the outer conductive portions 11, 12. Specifically, the ferrite insert 13 is disposed in a matter that substantially occupies the annular gap G between the conductive portions 11, 12, yet without affecting the formation of the capacitive gap C at the respective upper ends 11*a*, 12*a* thereof. In one particular embodiment, an inner diameter dl of the ferrite insert 13 (which is substantially equal to an outer diameter of the inner conductive portion 11) is about 12 mm. An outer diameter d2 of the ferrite insert 13 (which is substantially equal to an inner diameter of the outer conductive portion 12) is about 28 mm. An outer diameter of the outer conductive portion 12 is about 32 mm.

The height hl of the inner conductive portion 11 is about 23 mm above the bottom plate of the resonator unit 10, while the height h2 of the ferrite insert 13 is about 22 mm (thus making it stand slightly shorter than the inner conductive portion 11) to ensure that the insert 13 does not interfere with the formation of the capacitive gap C. The capacitive gap C is maintained at about a 2 mm of separation. Nevertheless, the structural dimension of the device is subject to adjustment in accordance with specific applications and practical requirements.

The tunable filter design of the instant disclosure is generally based on the manipulation of the magnetic permeability of the ferrite insert 13 to permit the filter to be tunable over a certain range around the center frequencies. As shown in FIG. 3A, with the absence of the ferrite insert 13 occupying the annular gap G between the coaxially arranged inner/outer conductive portions 11, 12, the resonator unit 10 would behave like a static filter. Particularly, the capacitive gap C defined between the respective upper ends 11*a*, 12*a* (i.e., the capacitive end 10*a* of the resonator unit 10) serves as a capacitive termination, while the connected bottom ends 11*b*, 12*b* (i.e., the shoring end 10*b*) function as a shorting termination of a coaxial transmission line. Specifically, without the ferrite insert 13, the annular gap G forms an air cavity in the coaxial resonator unit 10, which results in a constant magnetic $\mu=\mu_0$ (and likewise, a constant-valued electric permeability $\in=\in_0$) in the filter device. However, with the presence of the ferrite insert 13, filter adjustment may be enabled by exerting a biasing magnetic field through there-through. As shown in FIG. 3B, when a biasing magnetic field $H_0$ is provided (in the direction parallel to the longitudinal axis z) through the ferrite insert 13, the magnetic and electric constants $\mu$ and $\in$ will be altered. Particularly, the effective magnetic permeability $\mu$ of the ferrite may be altered as a function of the exerted magnetic field $H_0$ (e.g., $\mu=\mu_{eff}(H_0)$). Thus, by adjusting the strength of the biasing magnetic field $H_0$, the operating characteristic (e.g., frequency) of the filter device may be tuned.

In general, the permeability $\mu$ of the ferrite changes when a magnetic biasing field is applied. The change in permeability results in a change in the velocity of standing waves (Vp) between coupled filter conductors (e.g., conductive portions 11, 12), according to the relationship $Vp=c\sqrt{u_r}$. This change in standing wave velocity results in a change in the frequency of the standing wave, $f=Vp/2\lambda$. The magnetic biasing may be produced by a current-induced magnetic field, such as one generated by winding a copper coil around the resonator unit 10 and applying a d-c current thereto. A d/c current applied to the winding produces a biasing magnetic field along the longitudinal axis of the resonator, which in turn changes the magnetic permeability of the ferrite, and thereby altering the center frequency of the filter. By varying the coil current, one can either increase or decrease the permeability of the ferrite, thus changing the standing wave velocity (Vp) and hence the frequency, ($v=Vp/2\lambda$). This enables tuning of the center frequency of a filter device.

Particularly, the annular tubular configuration of the ferrite insert 13 reflects a noticeable increase in ferrite volume, which may translate to flexible yet balanced tuning qualities in the filter device's adjustment range. Compared to the ubiquitous small-size ferrite arrangement adopted in conventional ferrite-tuned applications (e.g., planar ferrite configuration, through which the magnetic biasing field exhibits substantial uniformity), a fully uniform bias field distribution in the large annular volume of the ferrite insert 13 is not achieved. As a result, the resonance frequency of the exemplary filter element is substantially a function of the spatial distribution of the bias field inside the entire annular tubular ferrite volume, thus displaying inhomogeneous biasing characteristics.

Figure 4:
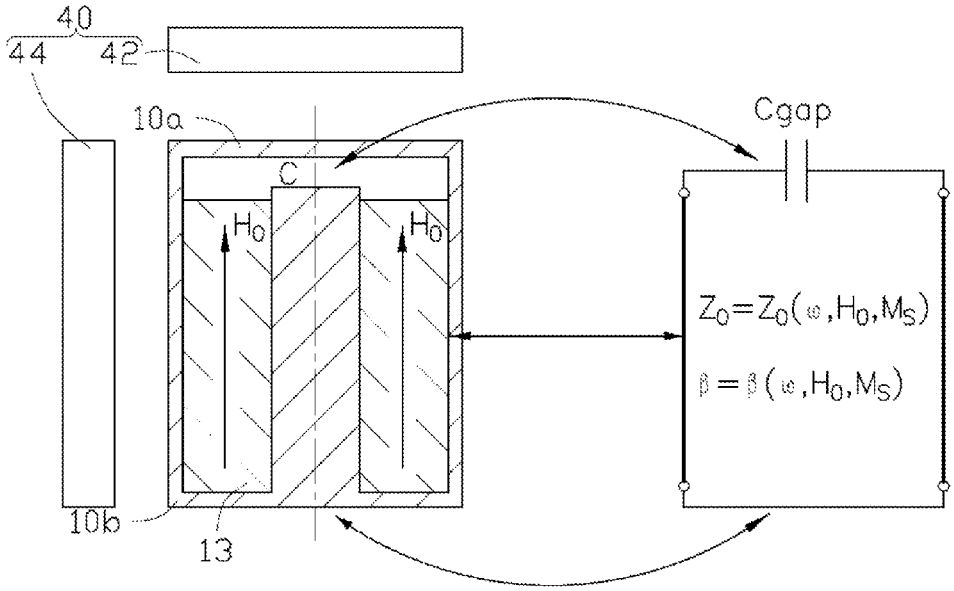
FIG. 4 illustrates a schematic cross-sectional view of a filter device along its longitudinal axis and a simplified equivalent circuit thereof in accordance with some embodiments of the instant disclosure.

FIG. 4 illustrates a schematic cross-sectional view of a filter device along its longitudinal axis and an equivalent circuit thereof in accordance with some embodiments of the instant disclosure. The filter device of the instant embodiment utilizes a transverse biasing scheme, where a biasing magnetic field (e.g., a d/c magnetic field) is provided perpendicular to a radio frequency (RF) magnetic field associated with a propagating signal through the filter device. The transverse biasing scheme generally endows favorable low loss characteristics in filter devices. The low loss characteristics in turn translated into high unloaded resonator Q factors and hence low insertion losses in filters.

Particularly, the filter device of the instant embodiment employs a magnetic bias inducing unit 40 arranged proximal to the resonator unit 10, configured to generate a magnetic biasing field (such as biasing field $H_0$) oriented generally perpendicular to the high frequency magnetic field propagating in the resonator unit 10. In the instant embodiment, the magnetic bias inducing unit 40 comprises a static biasing component 42 and a variable biasing component 44. The static biasing component 42 may be implemented in the form of permanent magnets. For instance, the static magnetic component 42 arranged at fix proximity of the resonator unit 10 (e.g., above and/or below the ferrite insert 13 along the longitudinal axis) to induce a static magnetic field through the ferrite insert 13 in a direction substantially parallel to the longitudinal axis z. The variable biasing component 44, on the other hand, may be provided in the form of an electromagnet (such as conductive coil windings arranged around the resonator unit 10) configured to induce a variable magnetic field superposing the static field generated by the static magnetic component 42 (also in the direction substantially along the longitudinal axis z).

The static biasing component 42 may be configured to generate a static magnetic field having a magnitude that substantially pre-magnetizes the ferrite insert 13 into magnetic saturation, so that the ferrite insert 13 is operated above its gyromagnetic resonance. In the saturated state, the ferrite insert 13 is substantially loss-free and upon further increase of the biasing field the microwave properties of the ferrite insert may be influenced to such an extent that the electric length of the resonator unit 10 changes. On the other hand, the variable component of the magnetic biasing field (e.g., the component generated by the variable biasing component 42) affects the actual tuning of the filter device in the substantially loss-free condition. The concurrent use of a permanent/static biasing component 42 and a variable biasing component 44 offers the benefit that only a relatively small current are required to tune the ferrite loaded resonator unit 10. Nevertheless, the inclusion of the static biasing component 42 is not mandatory. In some embodiments, the static/permanent component of the bias inducing unit 40 is omitted in favor of device simplicity.

Figure 5A:
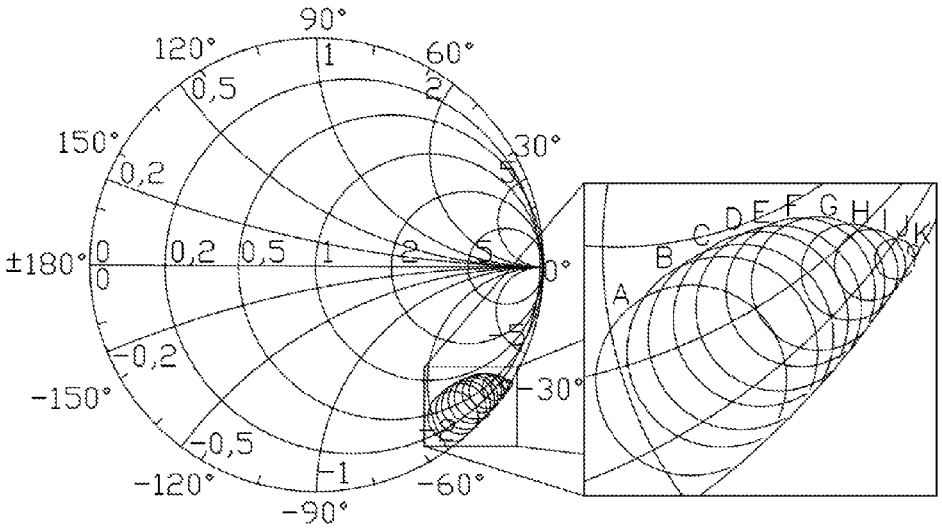
FIG. 5A shows reflection coefficient curves of a filter device in accordance with some embodiments of the instant disclosure.

FIG. 5A shows reflection coefficient curves of a filter device in accordance with some embodiments of the instant disclosure. Particularly, FIG. 5A provides a Smith chart showing the measured reflection coefficients for varying levels of magnetic bias (e.g., 11 different bias levels, labeled A-K). Each of these curves trances a circle in the vicinity of a corresponding resonance. The resonance parameters (e.g., the resonance frequency $f_0$, the unloaded quality factor $Q_0$, and the coupling coefficient $k_c$) can be extracted from the data by analyzing the circles' positions and dimensions as well as the frequency ranges they span.

Figure 5B:
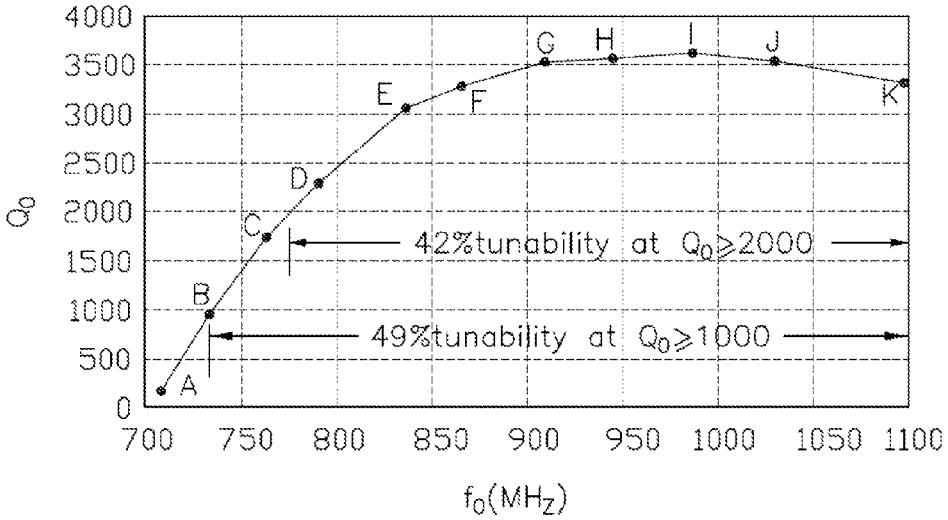
FIG. 5B shows a frequency vs. quality factor curve of a filter device in accordance with some embodiments of the instant disclosure.

FIG. 5B shows a frequency vs. quality factor curve of a filter device in accordance with some embodiments of the instant disclosure. Specifically, the resonances correspond to the different ferrite bias levels (A-K) are analyzed by fitting the best-matching circles to the measured data, and the variation of $Q_0$ with respect to $f_0$ is shown in FIG. 5B. It can be seen that $Q_0$ does not remain constant across the tuning range. Specifically, in the lower half of the plot, $Q_0$ increases with the decrease of magnetic losses of the ferrite due to deeper saturation. This steep increase is due to the absence of a static bias inducing unit (such as the permanent biasing unit 42) that pre-magnetizes the ferrite insert 13 into magnetic saturation. In contrast, in the upper half of the plot, the slope reduces as the ferrite insert reaches deep magnetic saturation. In one embodiment, the tenability of the filter is measured to be about 42%. The tenability of the device may be improved by further engineering of the magnetic biasing circuit (e.g., the bias inducing unit 40).

Figure 6:
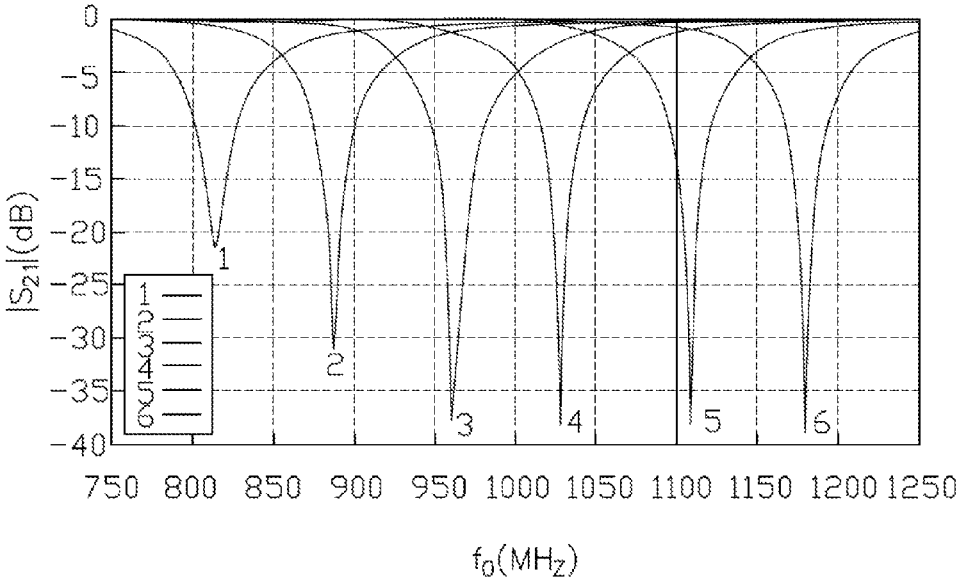
FIG. 6 illustrates a plot showing the transmission characteristics of a tunable notch filter in accordance with some embodiments of the instant disclosure.

FIG. 6 illustrates a plot showing the transmission characteristics of a tunable notch filter in accordance with some embodiments of the instant disclosure. Particularly, FIG. 6 shows the response curve one particular embodiment, through which biasing fields with bias states 1 to 6 (with gradually increasing biasing field strengths) are applied. It is seen that, in the instant example, the notch frequency band may be tuned from about 813 MHz to about 1180 MHz, which generally corresponds to a tuning ratios of 45%. The variation of $Q_0$ with $f_0$ can be identified by the way that the notch depth first increases (e.g., from states 1 to 3), and subsequently stabilized (e.g., from states 3 to 6). The pass-band (i.e., off-resonance) insertion loss varies between 0.2 dB to un-measurably low values as the strength of the biasing field increases.

FIG. 7 shows an isometric see-through illustration of another filter device in accordance with some embodiments of the instant disclosure. Particularly, the instant exemplary device comprises a pair of resonator units 102, 104 coupled together to form a tunable combined filter. Each of the resonator units 102, 104 may be structurally comparable to that depicted in the previous examples (e.g., the resonator unit 10 shown in FIG. 2). In the instant embodiment, the respective outer conductive portions of the resonator units 102, 104 are connected through a bridge portion 106, while the inner conductive portions thereof are in signal connection through an interconnecting pin 206, which extends penetratively through the respective ferrite inserts of the resonator units 102, 104. In addition, each of the resonator units 102/104 is provided with an access port 202/204 for signal reception/extraction. Depending on application requirements, more than two resonator units may be coupled together in a comparable fashion.

Figure 8:
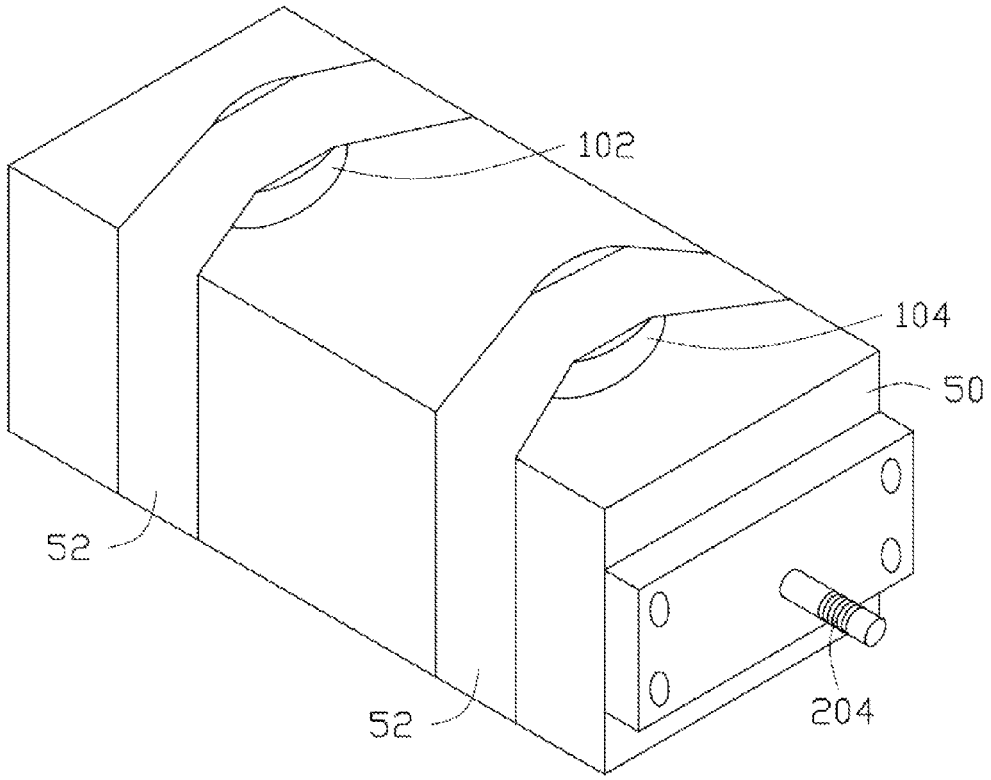
FIG. 8 shows a perspective view of a filter device having a double resonator configuration in accordance with some embodiments of the instant disclosure.

FIG. 8 shows a perspective view of a filter device in accordance with some embodiments of the instant disclosure. In the instant embodiment, an external housing 50 is provided to receive the resonator units 102, 104, whose top portions are visibly exposed there-from. An access port (e.g., a signal connector 204) is protrudingly arranged on a lateral surface of the housing 50. In addition, reflective wrappings 52 (made of, e.g., gold material) are applied around each of the resonator units 102/104 to reduce losses and improve filter quality.

The filter device in accordance with embodiments of the instant disclosure displays a balanced compromise between tenability and unloaded quality factor characteristics. By utilizing transversely biased ferrite-loaded shortened coaxial resonators, the disclosed filter design is capable of delivering practically wide tuning range while maintaining moderately high resonator Q values, thereby achieving tunability and low-loss characteristics at the same time. Moreover, the tuning behavior is expressed in terms of the non-uniform biasing distribution in the large-size ferrite body. It is worth noting that, with the implementation of suitable tapped coupling arrangements, the instantly disclosed filter design may be applied to notch filters as well as band-pass filters to obtain favorable tunability and low-loss characteristics.

Accordingly, one aspect of the instant disclosure provides a tunable filter element that comprises a resonator unit that defines a longitudinal axis, the resonator unit includes an inner conducting portion defining an inner shorting end along the longitudinal axis and an inner capacitive end opposing the inner shorting end, an outer conducting portion arranged around the inner conductor defining an outer shorting end along the longitudinal axis and an outer capacitive end opposite to the outer shorting end. The inner and the outer conductors maintain an annular gap there-between in a cross-section normal to the longitudinal axis. The inner and the outer shorting ends are electrically connected to form a shorting end of the resonator. The inner and the outer capacitive ends cooperatively form an equivalent capacitor. The filter element further comprises a ferrite insert disposed between the inner and the outer conducting portions and substantially filling the annular gap, the ferrite insert being configured to receive a bias magnetic field in a direction substantially parallel to the longitudinal axis.

Accordingly, another aspect of the instant disclosure provide a tunable filter device, which comprises: a resonator unit that defines a longitudinal axis, the resonator unit includes an inner conducting portion defining an inner shorting end along the longitudinal axis and an inner capacitive end opposing the inner shorting end, an outer conducting portion arranged around the inner conductor defining an outer shorting end along the longitudinal axis and an outer capacitive end opposite to the outer shorting end, wherein the inner and the outer conductors maintain an annular gap there-between in a cross-section normal to the longitudinal axis, wherein the inner and the outer shorting ends are electrically connected to form a shorting end of the resonator, wherein the inner and the outer capacitive ends cooperatively forms an equivalent capacitor; a ferrite insert disposed between the inner and the outer conducting portions and substantially filling the annular gap; and a magnetic field source configured to generate a bias magnetic field through the ferrite insert in a direction substantially parallel to the longitudinal axis.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A tunable filter element, comprising:

a resonator unit that defines a longitudinal axis, the resonator unit includes an inner conducting portion defining an inner shorting end along the longitudinal axis and an inner capacitive end opposing the inner shorting end, an outer conducting portion arranged around the inner conductor defining an outer shorting end along the longitudinal axis and an outer capacitive end opposite to the outer shorting end, wherein the inner and the outer conductors maintain an annular gap there-between in a cross-section normal to the longitudinal axis, the inner and the outer shorting ends are electrically connected to form a shorting end of the resonator, the inner and the outer capacitive ends cooperatively form a capacitor;

a ferrite insert disposed between the inner and the outer conducting portions and substantially filling the annular gap, the ferrite insert being configured to receive a bias magnetic field in a direction substantially parallel to the longitudinal axis; and a dielectric insert disposed in the capacitive gap;

wherein the inner and outer capacitive ends of the respective inner and outer conducting portions maintain a capacitive gap.

2. The filter element of claim 1, wherein the inner and the outer conductive portions are of integral unitary construction.

3. The filter element of claim 1, wherein the inner conducting portion is substantially symmetric about the longitudinal axis.

4. The filter element of claim 3, wherein the inner conducting portion has a substantially circular profile in the cross-section normal to the longitudinal axis.

5. The filter element of claim 1, wherein the outer conducting portion is substantially symmetric about the longitudinal axis.

6. The filter element of claim 5, wherein the outer conducting portion has a substantially circular ring profile in the cross-section normal to the longitudinal axis.

7. The filter element of claim 1, further comprising a tapping port arranged on a lateral surface of the outer conductive portion and enables access to the inner conducting portion through the ferrite insert.

8. The filter element of claim 7, further comprising a tapping connector arranged on the lateral surface of the outer conducting portion receiving the tapping port.

9. The filter element of claim 8, wherein the tapping connector is a coaxial connector having an inner pin that establishes signal connection with the inner conducting portion through the tapping port.

10. A tunable filter device, comprising:

a resonator unit that defines a longitudinal axis, the resonator unit includes an inner conducting portion defining an inner shorting end along the longitudinal axis and an inner capacitive end opposing the inner shorting end, an outer conducting portion arranged around the inner conductor defining an outer shorting end along the longitudinal axis and an outer capacitive end opposite to the outer shorting end, wherein the inner and the outer conductors maintain an annular gap there-between in a cross-section normal to the longitudinal axis, the inner and the outer shorting ends are electrically connected to form a shorting end of the resonator, the inner and the outer capacitive ends cooperatively form a capacitor;

a ferrite insert disposed between the inner and the outer conducting portions and substantially filling the annular gap;

a magnetic biasing unit configured to generate a bias magnetic field through the ferrite insert in a direction substantially parallel to the longitudinal axis; and a dielectric insert disposed in the capacitive gap;

wherein the inner and outer capacitive ends of the respective inner and outer conducting portions maintain a capacitive gap.

11. The device of claim 10, wherein the inner conducting portion is substantially symmetric about the longitudinal axis.

12. The device of claim 10, wherein the outer conducting portion is substantially symmetric about the longitudinal axis.

13. The device of claim 10, further comprising an external housing configured to at least partially receive the resonator unit.

14. The device of claim 10, further comprising a second one of the resonator unit, wherein the pair of resonator units are signally coupled by an interconnecting pin extending through the respective ferrite inserts thereof.

15. The device of claim 10, wherein the magnetic field source comprises a static biasing component.

16. The device of claim 15, wherein the static magnetic component generates a premagnetizing field that substantially biases the ferrite to saturation.

17. The device of claim 10, wherein the magnetic field source comprises a variable biasing component.

18. The device of claim 17, wherein the variable magnetic component comprises an electromagnet.

* * * * *